US011412791B2

(12) United States Patent
Kunar

(10) Patent No.: US 11,412,791 B2
(45) Date of Patent: Aug. 16, 2022

(54) ALL-WEATHER PROTECTIVE FACE MASK

(71) Applicant: Edward Kunar, Ravenna, OH (US)

(72) Inventor: Edward Kunar, Ravenna, OH (US)

( * ) Notice: Subject to any disclaimer, the term of this patent is extended or adjusted under 35 U.S.C. 154(b) by 276 days.

(21) Appl. No.: 16/835,461

(22) Filed: Mar. 31, 2020

(65) Prior Publication Data

US 2021/0298379 A1 Sep. 30, 2021

(51) Int. Cl.
*A41D 13/11* (2006.01)

(52) U.S. Cl.
CPC ..... *A41D 13/1161* (2013.01)

(58) Field of Classification Search
CPC ..... A41D 13/1161; A41D 13/1184; A41D 13/11; A41D 13/1153; A61F 9/06
See application file for complete search history.

(56) References Cited

U.S. PATENT DOCUMENTS 1,171,973 A * 2/1916 Patterson ..... A41D 13/11 128/863
1,323,217 A * 11/1919 Darrow ..... A61M 16/0808 128/205.12
1,586,141 A * 5/1926 Buckley ..... A61F 9/045 2/209.5
1,659,229 A * 2/1928 Wood ..... A61F 9/045 2/12
2,016,775 A * 10/1935 Gingg ..... A61F 9/06 2/8.2
2,363,461 A * 11/1944 Huntsman ..... A61F 9/06 2/8.1
2,406,092 A * 8/1946 Meyer ..... A61F 9/06 2/8.1
2,544,457 A * 3/1951 Harrington ..... A61F 9/06 2/8.1
2,588,553 A * 3/1952 McWethy ..... A61F 9/06 2/8.1
2,729,820 A * 1/1956 Anderson ..... A42B 3/225 2/9
2,736,027 A * 2/1956 Parmelee ..... A61F 9/06 2/8.1
2,898,596 A * 8/1959 Keen ..... A63B 71/10 2/421
3,040,741 A * 6/1962 Carolan ..... A62B 18/084 128/207.11

(Continued)

FOREIGN PATENT DOCUMENTS

GB 2035807 6/1980

*Primary Examiner* — Alissa L Hoey
(74) *Attorney, Agent, or Firm* — Kyle A. Fletcher, Esq.

(57) ABSTRACT

The all-weather protective face mask is a garment. The all-weather protective face mask is worn on the head of a client. The all-weather protective face mask forms a protected space around the face of the client. The all-weather protective face mask comprises a suspension band, a plurality of facepieces, a plurality of face guards, plurality of guard mounts, and a protective structure. The suspension band suspends the all-weather protective face mask from the head of the client. The plurality of facepieces secure the suspension band to the head of the client. The plurality of guard mounts attach the plurality of face guards to the plurality of facepieces. The protective structure forms the protected that encloses the face of the client. The protective structure mounts on the plurality of face guards.

16 Claims, 5 Drawing Sheets

(56) References Cited

U.S. PATENT DOCUMENTS 3,214,767 A * 11/1965 Weber ..... A61F 9/06 2/9
3,234,939 A * 2/1966 Morton, Jr. ..... A62B 18/084 128/206.27
3,327,316 A * 6/1967 Pukish, Jr. ..... A63B 71/10 D29/112
3,457,564 A * 7/1969 Holloway ..... A62B 18/084 2/452
3,696,442 A * 10/1972 Amundsen ..... A61F 9/06 2/8.1
4,095,290 A 6/1978 O'Brien
4,291,417 A * 9/1981 Pagano ..... A42B 1/201 2/202
4,349,081 A * 9/1982 Pepple ..... H04R 25/00 181/130
4,703,879 A * 11/1987 Kastendieck ..... A61F 9/027 359/477
4,825,474 A 5/1989 Edwards
4,941,211 A 7/1990 Blutstein
4,986,282 A * 1/1991 Stackhouse ..... A61F 9/02 128/857
4,999,856 A * 3/1991 DuVall ..... A42B 3/20 2/9
5,216,758 A * 6/1993 Rabquer ..... A42B 3/20 2/9
5,479,658 A * 1/1996 Harris ..... A42B 3/20 2/9
5,692,522 A * 12/1997 Landis ..... A61F 9/02 128/857
5,845,340 A 12/1998 Frislie
5,884,336 A 3/1999 Stout
6,016,808 A * 1/2000 Landis ..... A61F 9/045 2/9
6,367,085 B1 * 4/2002 Berg ..... A62B 17/04 2/202
7,490,359 B2 * 2/2009 Landis ..... A61F 9/045 2/427
D638,170 S 5/2011 Chen
8,234,722 B2 * 8/2012 VanDerWoude ..... A42B 3/286 2/410
8,733,357 B2 5/2014 Sullivan, Jr.
D783,238 S 4/2017 Del Bene
10,004,968 B2 * 6/2018 Valadez ..... A42B 3/0406
10,455,871 B2 * 10/2019 Pearce ..... A41D 13/1107
11,006,681 B1 * 5/2021 Campos ..... A41D 13/1184
2010/0235971 A1 * 9/2010 Ahlgren ..... A42B 3/145 2/416
2011/0220115 A1 * 9/2011 Castiglione ..... A61M 16/0683 128/207.11
2013/0139289 A1 * 6/2013 Booth Jackson ..... A41D 20/00 2/12
2014/0216463 A1 * 8/2014 Cowell ..... A62B 18/084 128/207.11
2014/0304887 A1 10/2014 Ilges
2015/0089709 A1 4/2015 DuCasse
2016/0361201 A1 * 12/2016 Sommers ..... A42B 3/06
2018/0056098 A1 * 3/2018 Kaye ..... G02B 27/0172
2018/0338550 A1 * 11/2018 Boulware ..... A41D 13/1161
2019/0029355 A1 * 1/2019 Seo ..... A61F 9/06
2021/0321694 A1 * 10/2021 Abraham ..... A41D 13/1184
2021/0345698 A1 * 11/2021 Chatzidakis ..... A41D 13/1161
2021/0345701 A1 * 11/2021 Mamatas ..... A41F 1/008
2021/0361000 A1 * 11/2021 Choi ..... A41D 13/1184
2021/0368885 A1 * 12/2021 Atri ..... A41D 13/1184
2021/0378328 A1 * 12/2021 Vieira ..... A41D 13/1161
2021/0386137 A1 * 12/2021 Martino ..... A41D 13/1184
2021/0392970 A1 * 12/2021 Basta ..... A41D 13/1184
2021/0392973 A1 * 12/2021 Whitehead ..... A42B 3/145
2021/0401084 A1 * 12/2021 Lamoncha ..... A41D 13/1161
2022/0007774 A1 * 1/2022 Wells ..... A42B 3/20
2022/0015473 A1 * 1/2022 Akyea-Djamson ..... A41D 13/1161
2022/0023674 A1 * 1/2022 Kohrman ..... A61M 16/06
2022/0030976 A1 * 2/2022 Harris ..... A41D 13/1161
2022/0053851 A1 * 2/2022 Nickel ..... A41D 13/1161

* cited by examiner

ALL-WEATHER PROTECTIVE FACE MASK

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of wearing apparel including protective garments, more specifically, a protective face mask providing protection with against foul weather that incorporates a visor or shield. (A41D13/1184)

SUMMARY OF INVENTION

The all-weather protective face mask is a garment. The all-weather protective face mask is worn on the head of a client. The all-weather protective face mask forms a protected space around the face of the client. The all-weather protective face mask comprises a suspension band, a plurality of facepieces, a plurality of face guards, plurality of guard mounts, and a protective structure. The suspension band suspends the all-weather protective face mask from the head of the client. The plurality of facepieces secure the suspension band to the head of the client. The plurality of guard mounts attach the plurality of face guards to the plurality of facepieces. The protective structure forms the protected space that encloses the face of the client. The protective structure mounts on the plurality of face guards.

These together with additional objects, features and advantages of the all-weather protective face mask will be readily apparent to those of ordinary skill in the art upon reading the following detailed description of the presently preferred, but nonetheless illustrative, embodiments when taken in conjunction with the accompanying drawings.

In this respect, before explaining the current embodiments of the all-weather protective face mask in detail, it is to be understood that the all-weather protective face mask is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the all-weather protective face mask.

It is therefore important that the claims be regarded as including such equivalent construction insofar as they do not depart from the spirit and scope of the all-weather protective face mask. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
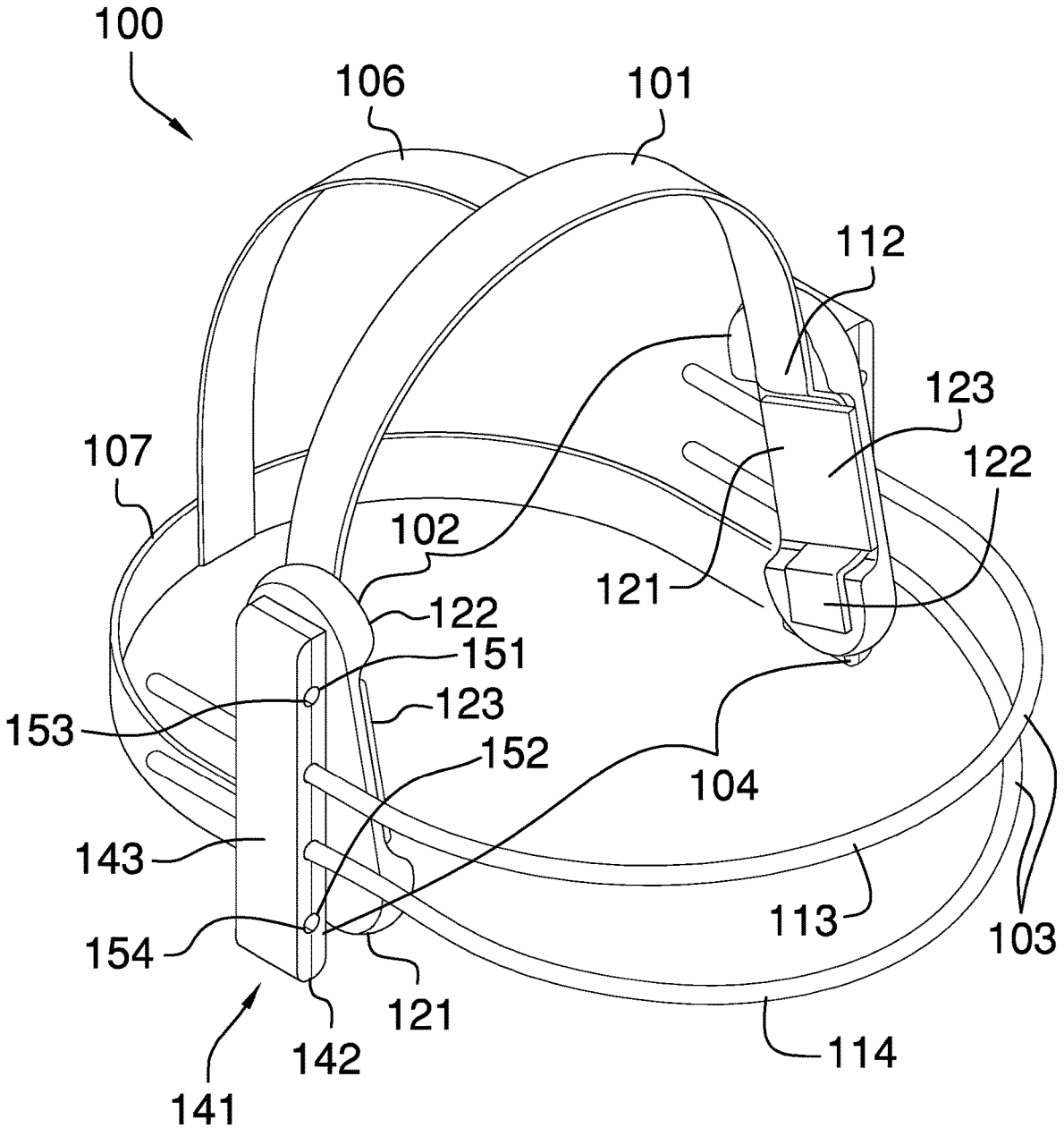
FIG. 1 is a perspective view of an embodiment of the disclosure.
Figure 2:
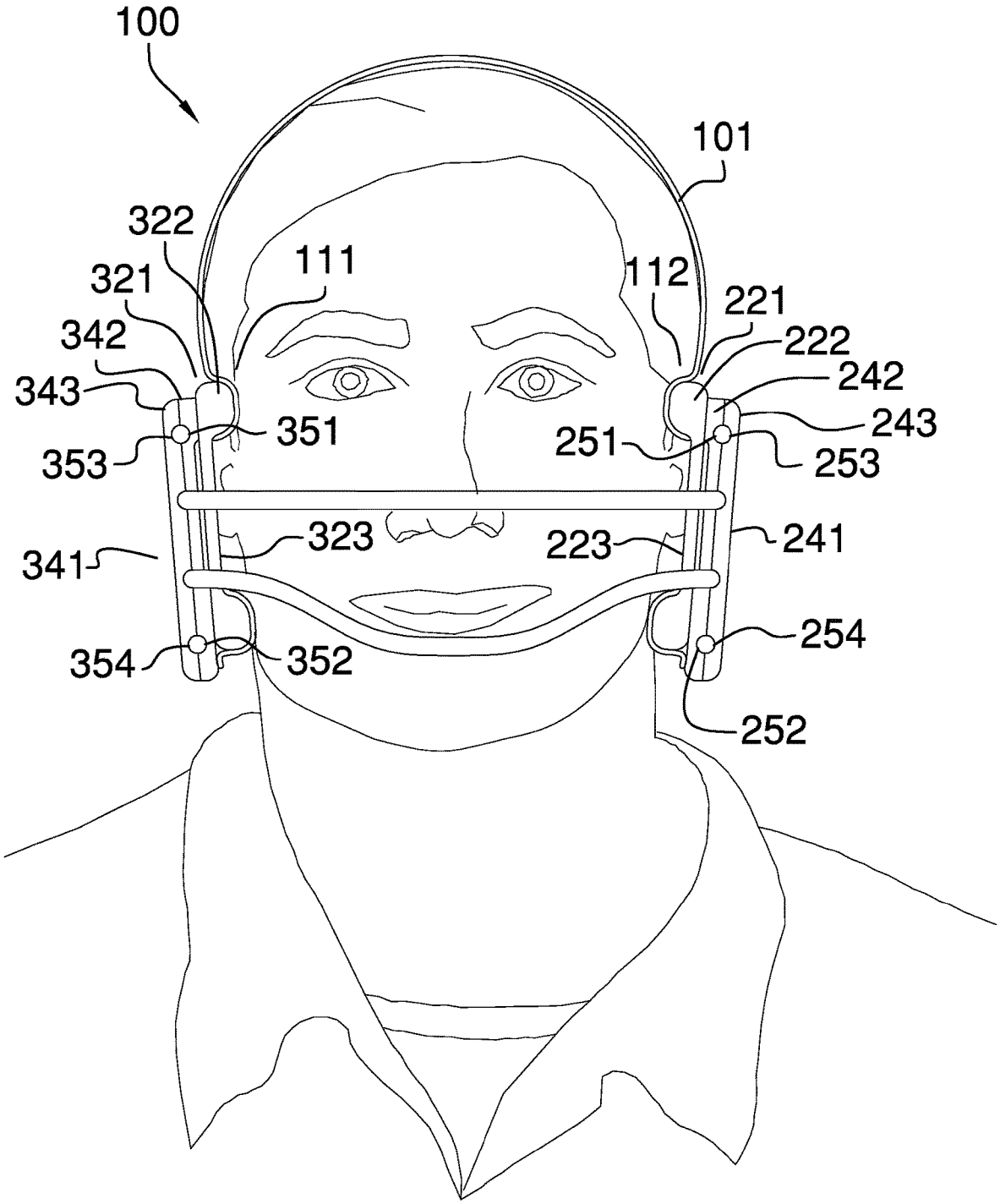
FIG. 2 is a front view of an embodiment of the disclosure.
Figure 3:
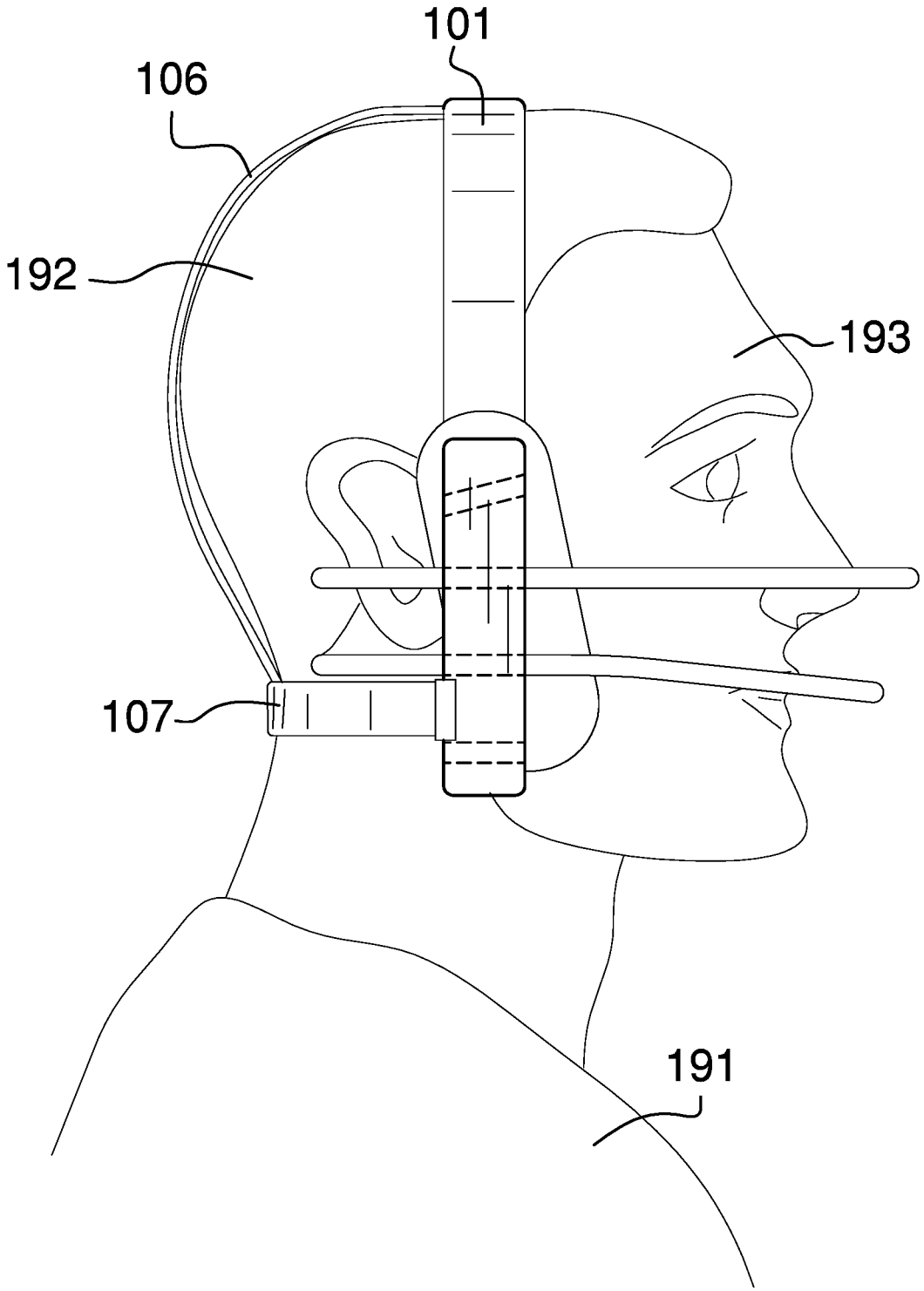
FIG. 3 is a side view of an embodiment of the disclosure.
Figure 4:
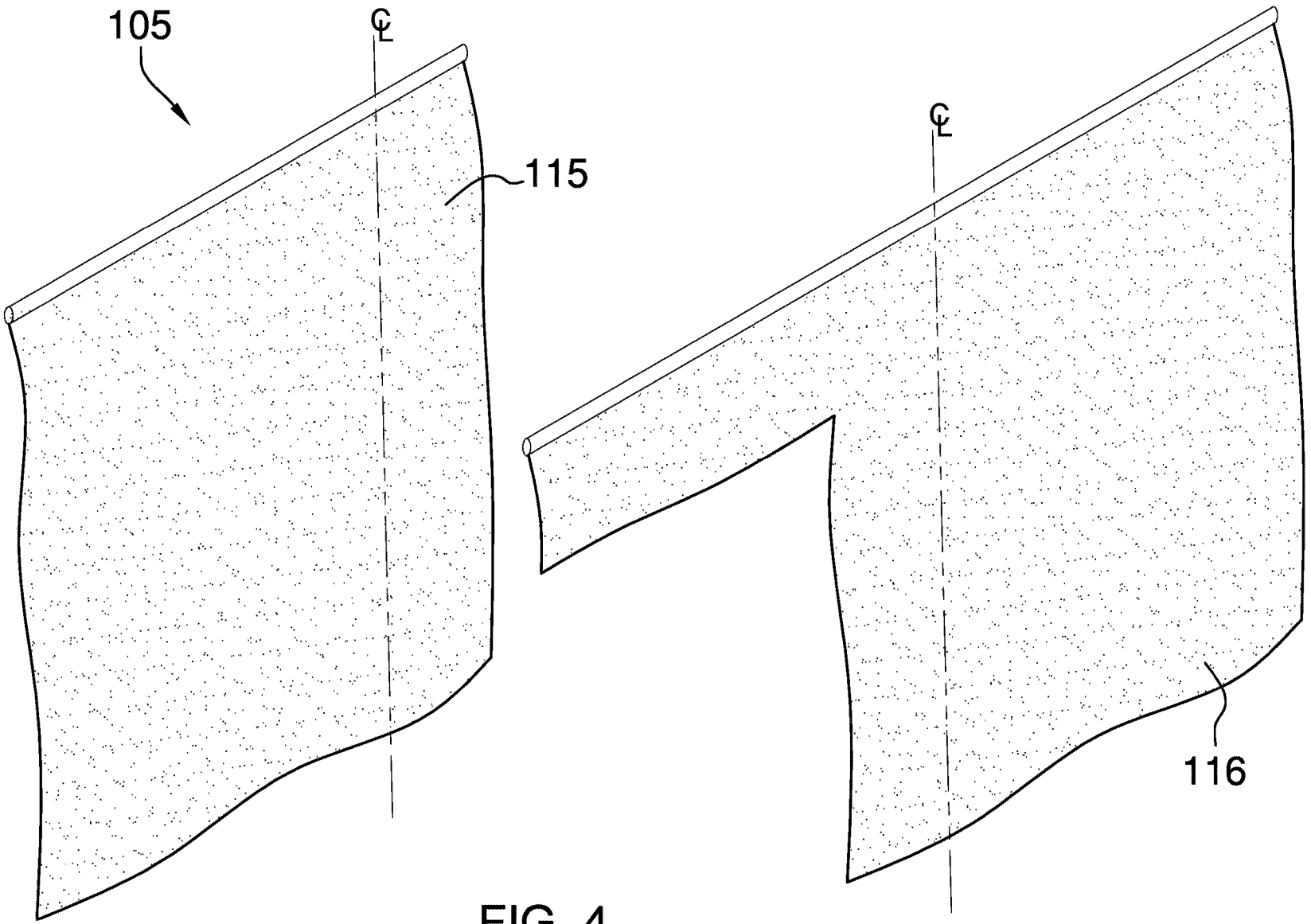
FIG. 4 is a detail view of an embodiment of the disclosure.
Figure 5:
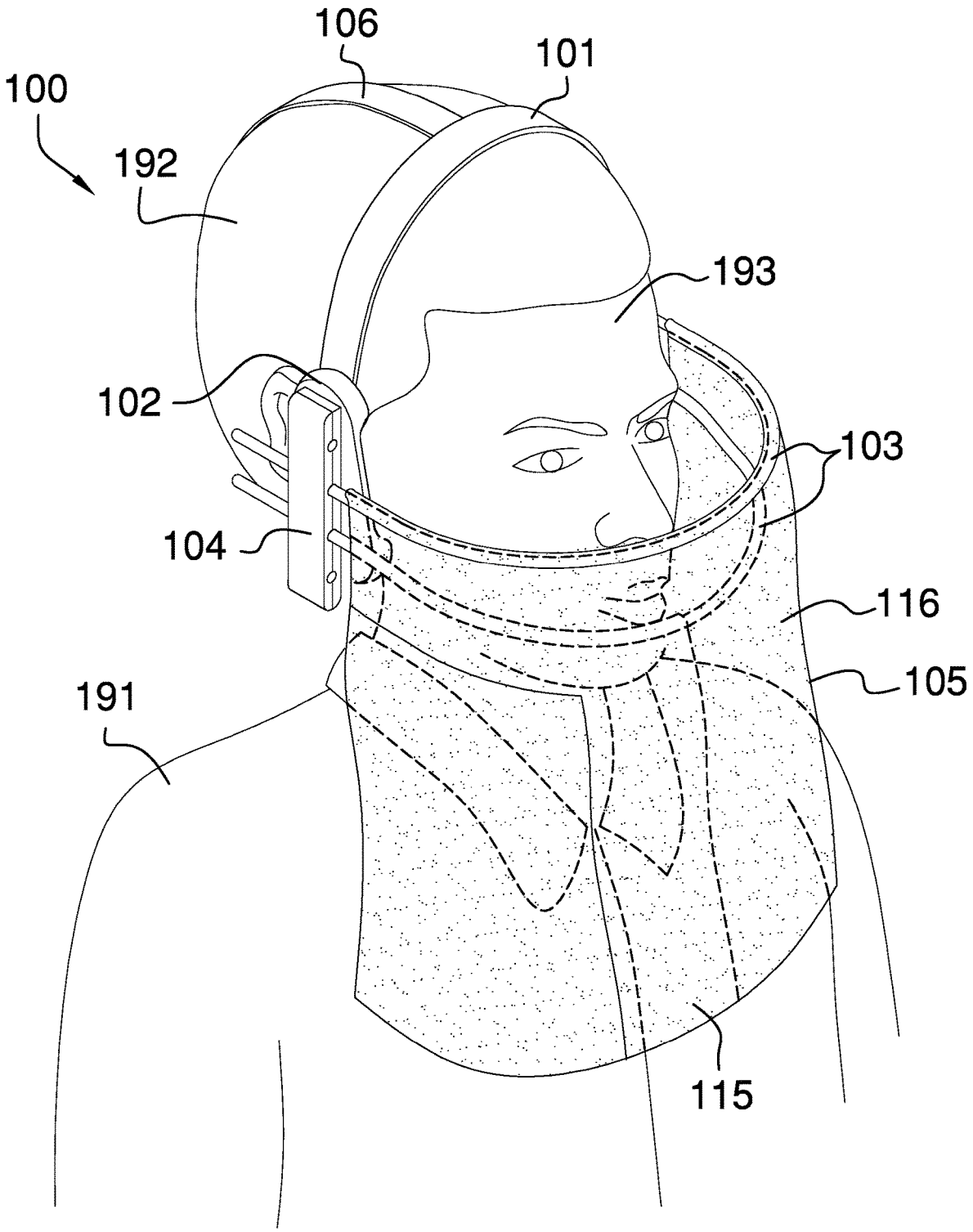
FIG. 5 is an in-use view of an embodiment of the disclosure.

Detailed reference will now be made to one or more potential embodiments of the disclosure, which are illustrated in FIGS. 1 through 5.

The all-weather protective face mask 100 (hereinafter invention) is a garment. The invention 100 is worn on the head 192 of a client 191. The invention 100 forms a protected space around the face 193 of the client 191. The invention 100 comprises a suspension band 101, a plurality of facepieces 102, a plurality of face 193 guards 103, a plurality of guard mounts 104, and a protective structure 105. The suspension band 101 suspends the invention 100 from the head 192 of the client 191. The plurality of facepieces 102 secure the suspension band 101 to the head 192 of the client 191. The plurality of guard mounts 104 attach the plurality of face 193 guards 103 to the plurality of facepieces 102. The protective structure 105 forms the protected space that encloses the face 193 of the client 191. The protective structure 105 mounts on the plurality of face 193 guards 103.

The suspension band 101 is a non-Euclidean disk structure. The non-Euclidean disk structure of the suspension band 101 comprises a concave and a convex surface. The suspension band 101 is a semi-rigid structure with an elastic nature. The suspension band 101 is worn over the superior surface of the head 192 of the client 191. The suspension band 101 is deformed as the suspension band 101 such that a force is generated by the suspension band 101 as it returns to its relaxed shape. This generated force secures the suspension band 101 to the head 192 of the client 191. The suspension band 101 fits on the head 192 of the client 191 such that the plurality of facepieces 102 fit against the face of the client 191. The suspension band 101 further comprises a sinister end 111 and a dexter end 112.

The sinister end 111 refers to the point on the lateral face of the non-Euclidean disk structure that: a) is distal from the center point of the suspension band 101; b) is distal from the dexter end 112; and, c) is proximal to the client 191.

The dexter end 112 refers to the point on the lateral face of the non-Euclidean disk structure that: a) is distal from the center point of the suspension band 101; b) is distal from the sinister end 111; and, c) is proximal to the client 191.

The suspension band 101 further attaches to a superior medial band 106 and a lateral band 107. The superior medial band 106 and the lateral band 107 secure the suspension band 101 to the top and back of the head 192 of the client 191.

The superior medial band 106 is a semi-rigid structure with an elastic nature. The superior medial band 106 is worn over the superior surface of the head 192 of the client 191 such that the superior medial band 106 is perpendicular to the suspension band 101. The superior medial band 106 is deformed as the superior medial band 106 is placed on the head 192 of the client 191 such that a force is generated by the suspension band 101 as it returns to its relaxed shape. This generated force secures the superior medial band 106 to the head 192 of the client 191.

The lateral band 107 is a semi-rigid structure with an elastic nature. The lateral band 107 is worn over the back of the head 192 of the client 191 such that the lateral band 107 is perpendicular to the superior medial band 106. The lateral band 107 is deformed as the lateral band 107 is placed on the head 192 of the client 191 such that a force is generated by the suspension band 101 as it returns to its relaxed shape. This generated force secures the lateral band 107 to the head 192 of the client 191.

Each of the plurality of facepieces 102 attaches to the convex surface of the suspension band 101. Each of the plurality of facepieces 102 are equidistant from the center of the suspension band 101. The position of each of the plurality of facepieces 102 is such that each facepiece selected from the plurality of facepieces 102 fits directly against a face of the client 191. The plurality of facepieces 102 comprise a collection of individual facepieces 121.

Each individual facepiece 121 is a rigid structure. Each individual facepiece 121 has the primary shape of a disk. Each individual facepiece 121 attaches at a position proximal to an end of the non-Euclidean disk structure of the suspension band 101. Each individual facepiece 121 attaches to the convex surface of the non-Euclidean disk structure of the suspension band 101. Each individual facepiece 121 fits against a face of the client 191. Each individual facepiece 121 attaches an individual guard mount 141 selected from the plurality of guard mounts 104 to the suspension band 101. Each individual facepiece 121 comprises an individual facepiece 121 plate 122 and an individual facepiece 121 cavity 123. The individual guard mount 141 selected to attach to the individual facepiece 121 attaches to the face of the disk structure of the individual facepiece 121 plate 122 that is distal from the client 191.

The individual facepiece 121 plate 122 is a rigid structure. The individual facepiece 121 plate 122 has the primary shape of a disk. The individual facepiece 121 plate 122 has a plate structure. The individual facepiece 121 plate 122 is sized such that the individual facepiece 121 plate 122 extends beyond the non-Euclidean disk structure of the suspension band 101 to a position against a face of the client 191.

The individual facepiece 121 cavity 123 is a negative space formed in the congruent end of the individual facepiece 121 plate 122 that is proximal to the head 192 of the client 191. The negative space that forms the individual facepiece 121 cavity 123 is a prism-shaped structure.

Each of the plurality of face 193 guards 103 is a non-Euclidean prism structure. Each of the plurality of face 193 guards 103 forms a curved structure that encloses the face 193 of the client 191. Each of the plurality of guard mounts 104 attach the plurality of face 193 guards 103 to the plurality of facepieces 102. Each of the plurality of face 193 guards 103 forms a mechanical structure to which the protective structure 105 attaches. The mechanical structure formed by each of the plurality of face 193 guards 103 holds the protective structure 105 away from the face 193 of the client 191. The plurality of face 193 guards 103 comprises a superior face 193 guard 113 and an inferior face 193 guard 114.

The superior face 193 guard 113 is a non-Euclidean prism structure. The superior face 193 guard 113 is a rigid structure. The superior face 193 guard 113 is positioned on the invention 100 such that the superior face 193 guard 113 encloses the face 193 of the client 191. The superior face 193 guard 113 is positioned on the invention 100 such that the protected space is formed between the protective structure 105 and the face 193 of the client 191.

The inferior face 193 guard 114 is a non-Euclidean prism structure. The inferior face 193 guard 114 is a rigid structure. The inferior face 193 guard 114 is positioned on the invention 100 such that the inferior face 193 guard 114 encloses the face 193 of the client 191. The inferior face 193 guard 114 is positioned on the invention 100 such that the protected space is formed between the protective structure 105 and the face 193 of the client 191.

Each guard mount selected from the plurality of guard mounts 104 attaches to an facepiece selected from the plurality of facepieces 102. The plurality of guard mounts 104 comprise a collection of individual guard mounts 141.

Each individual guard mount 141 is a mechanical structure. Each individual guard mount 141 is a rigid structure. Each individual guard mount 141 attaches each of the plurality of face 193 guards 103 to an individual facepiece 121 selected from the plurality of facepieces 102. Each individual guard mount 141 comprises an individual piece mount plate 142, and an individual guard clamp plate 143.

The individual piece mount plate 142 is a rigid structure. The individual piece mount plate 142 is a disk-shaped plate. The individual piece mount plate 142 is the component of the individual guard mount 141 that directly attaches to the individual facepiece 121 selected from the plurality of facepieces 102 that is associated with the selected individual guard mount 141. Each individual piece mount plate 142 comprises a first individual c-channel 151, and a second individual c-channel 152.

The first individual c-channel 151 is a negative space formed in the congruent end of the individual piece mount plate 142 that is distal from the head 192 of the client 191. The first individual c-channel 151 is geometrically similar to the prism shape of a face 193 guard selected from the plurality of face 193 guards 103. The first individual c-channel 151 is sized such that a face 193 guard selected from the plurality of face 193 guards 103 fits within the first individual c-channel 151. The second individual c-channel 152 is a negative space formed in the congruent end of the individual piece mount plate 142 that is distal from the head 192 of the client 191. The second individual c-channel 152 is geometrically similar to the prism shape of a face 193 guard selected from the plurality of face 193 guards 103. The second individual c-channel 152 is sized such that a face 193 guard selected from the plurality of face 193 guards 103 fits within the second individual c-channel 152.

The first individual c-channel 151 and the second individual c-channel 152 are formed in the individual piece mount plate 141 such that the first individual c-channel 151 and the second individual c-channel 152 form a cant relative to the force of gravity when the invention 100 is worn normally.

The individual guard clamp plate 143 is a rigid structure. The individual guard clamp plate 143 is a disk-shaped plate. The individual guard clamp plate 143 attaches to the individual piece mount plate 142. The individual guard clamp plate 143 encloses each of the plurality of face 193 guards 103 between the individual guard clamp plate 143 and the individual piece mount plate 142 such that each of the plurality of face 193 guards 103 are secured to the invention 100. The individual guard clamp plate 143 comprises a third individual c-channel 153, and a fourth individual c-channel 154.

The third individual c-channel 153 is a negative space formed in the congruent end of the individual guard clamp plate 143 that is proximal to the individual piece mount plate 142. The third individual c-channel 153 is geometrically similar to the prism shape of a face 193 guard selected from the plurality of face 193 guards 103. The third individual c-channel 153 is sized such that a face 193 guard selected from the plurality of face 193 guards 103 fits within the third individual c-channel 153. The fourth individual c-channel 154 is a negative space formed in the congruent end of the individual guard clamp plate 143 that is proximal to the individual piece mount plate 142. The fourth individual c-channel 154 is geometrically similar to the prism shape of a face 193 guard selected from the plurality of face 193 guards 103. The fourth individual c-channel 154 is sized such that a face 193 guard selected from the plurality of face 193 guards 103 fits within the fourth individual c-channel 154.

The protective structure 105 is a sheeting-based structure that forms the protected space that encloses the face 193 of the client 191. The protected space formed by the protective structure 105 protects the face 193 of the client 191 from the weather. The protective structure 105 forms a structure selected from the group consisting of a transparent structure and a semitransparent structure. The protective structure 105 comprises a rectangular mesh textile 115 and a rectilinear mesh textile 116.

The rectangular mesh textile 115 is a textile-based sheeting. The rectangular mesh textile 115 is formed as mesh structure. The rectangular mesh textile 115 is a semitransparent structure. The rectangular mesh textile 115 has a rectangular shape. The rectangular mesh textile 115 forms a portion of the physical protected space that protects the face 193 of the client 191 from the weather.

The rectilinear mesh textile 116 is a textile-based sheeting. The rectilinear mesh textile 116 is formed as mesh structure. The rectilinear mesh textile 116 is a semitransparent structure. The rectilinear mesh textile 116 has a rectilinear shape. The rectilinear mesh textile 116 forms a portion of the physical protected space that protects the face 193 of the client 191 from the weather.

The rectangular mesh textile 115 and the rectilinear mesh textile 116 both attach to the plurality of face 193 guards 103 such that the rectangular mesh textile 115 and the rectilinear mesh textile 116 overlay each other. The overlay structure of the protective structure 105 allows for the separation of the rectangular mesh textile 115 and the rectilinear mesh textile 116 such that fluids can enter and exit the protected space formed by the protective structure 105.

In the first potential embodiment of the disclosure, the plurality of facepieces 102 further comprises a sinister facepiece 221 and a dexter facepiece 321. The plurality of guard mounts 104 further comprises a sinister guard mount 241 and a dexter guard mount 341.

The sinister facepiece 221 is the individual facepiece 121 that is positioned on the sinister side of the head 192 of the client 191. The sinister facepiece 221 plate 222 is the individual facepiece 121 plate 122 that is positioned on the sinister side of the head 192 of the client 191. The sinister facepiece 221 cavity 223 is the individual facepiece 121 cavity 123 that is positioned on the sinister side of the head 192 of the client 191. Each sinister facepiece 221 comprises a sinister facepiece 221 plate 222 and a sinister facepiece 221 cavity 223.

The sinister guard mount 241 is the individual guard mount 141 that is positioned on the sinister side of the head 192 of the client 191. The sinister guard mount 241 further comprises a sinister piece mount plate 242, and a sinister guard clamp plate 243. The sinister piece mount plate 242 further comprises a first sinister c-channel 251 and a second sinister c-channel 252. The sinister guard clamp plate 243 further comprises a third sinister c-channel 253, and a fourth sinister c-channel 254.

The sinister piece mount plate 242 is the individual piece mount plate 142 that is positioned on the sinister side of the head 192 of the client 191. The sinister guard clamp plate 243 is the individual guard clamp plate 143 that is positioned on the sinister side of the head 192 of the client 191.

The first sinister c-channel 251 is the first individual c-channel 151 that is positioned on the sinister side of the head 192 of the client 191. The second sinister c-channel 252 is the second individual c-channel 152 that is positioned on the sinister side of the head 192 of the client 191. The third sinister c-channel 253 is the third individual c-channel 153 that is positioned on the sinister side of the head 192 of the client 191. The fourth sinister c-channel 254 is the fourth individual c-channel 154 that is positioned on the sinister side of the head 192 of the client 191.

The dexter facepiece 321 is the individual facepiece 121 that is positioned on the dexter side of the head 192 of the client 191. Each dexter facepiece 321 comprises a dexter facepiece 321 plate 322 and a dexter facepiece 321 cavity 323.

The dexter facepiece 321 plate 322 is the individual facepiece 121 plate 122 that is positioned on the dexter side of the head 192 of the client 191. The dexter facepiece 321 cavity 323 is the individual facepiece 121 cavity 123 that is positioned on the dexter side of the head 192 of the client 191.

The dexter guard mount 341 is the individual guard mount 141 that is positioned on the dexter side of the head 192 of the client 191. The dexter guard mount 341 comprises a dexter piece mount plate 342, and a dexter guard clamp plate 343. The dexter piece mount plate 342 further comprises a first dexter c-channel 351 and a second dexter c-channel 352. The dexter guard clamp plate 343 further comprises a third dexter c-channel 353, and a fourth dexter c-channel 354.

The dexter piece mount plate 342 is the individual piece mount plate 142 that is positioned on the dexter side of the head 192 of the client 191. The dexter guard clamp plate 343 is the individual guard clamp plate 143 that is positioned on the dexter side of the head 192 of the client 191. The first dexter c-channel 351 is the first individual c-channel 151 that is positioned on the dexter side of the head 192 of the client 191. The second dexter c-channel 352 is the second individual c-channel 152 that is positioned on the dexter side of the head 192 of the client 191. The third dexter c-channel 353 is the third individual c-channel 153 that is positioned on the dexter side of the head 192 of the client 191. The fourth dexter c-channel 354 is the fourth individual c-channel 154 that is positioned on the dexter side of the head 192 of the client 191.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anterior: As used in this disclosure, anterior is a term that is used to refer to the front side or direction of a structure. When comparing two objects, the anterior object is the object that is closer to the front of the structure.

C-Channel: As used in this disclosure, the C-channel is a structure that is formed in a U-shape. The C-channel forms a prism shape with a hollow interior and an open face that forms a shape characteristic of the letter C. The open space of the C-channel is often used as a track.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Channel: As used in this disclosure, a channel is a tubular passage through which an object or fluid is passed through.

Client: As used in this disclosure, a client is an individual who is designated to receive the services of the disclosure at bar.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Concave: As used in this disclosure, concave is used to describe: 1) a surface that resembles the interior surface of a sphere; or, 2) a function with a curvature structure wherein a chord that connects any two points of the function will be lesser than (graphically below) or equal to the value of the function at any point along the chord.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Convex: As used in this disclosure, convex is used to describe: 1) a surface that resembles the outer surface of a sphere; or, 2) a function with a curvature structure wherein a chord that connects any two points of the function will be greater than (graphically above) or equal to the value of the function at any point along the chord.

Correspond: As used in this disclosure, the term correspond is used as a comparison between two or more objects wherein one or more properties shared by the two or more objects match, agree, or align within acceptable manufacturing tolerances.

Dexter: As used in this disclosure, dexter is a directional reference that refers to the right side of the body or the right side of an object from the perspective of a viewer who is facing the posterior side of the object.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Flexible: As used in this disclosure, flexible refers to an object or material that will deform when a force is applied to it but that will not necessarily return to its original shape when the deforming force is removed.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Garment: As used in this disclosure, a garment is a textile based structure that is used to cover an individual. Clothes, clothing, and apparel are synonyms for garment.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Headgear: As used in this disclosure, headgear refers to a protective garment worn on the head, such as a hat.

Inferior: As used in this disclosure, the term inferior refers to a directional reference that is parallel to and in the same direction as the force of gravity.

Mesh: As used in this disclosure, the term mesh refers to an openwork fabric made from threads, yarns, cords, wires, or lines that are woven, knotted, or otherwise twisted or intertwined at regular intervals. Synonyms for mesh include net. A mesh structure formed from metal bars or wires is often referred to as a grate.

Non-Euclidean Disk: As used in this disclosure, a non-Euclidean structure is a disk-shaped structure wherein the congruent end (faces) of the disk structure lies on a non-Euclidean plane.

Non-Euclidean Prism: As used in this disclosure, a non-Euclidean prism is a prism structure wherein the center axis of the prism lies on a non-Euclidean plane or is otherwise formed with a curvature.

Non-Euclidean Structure: As used in this disclosure, a non-Euclidean structure is a structure wherein an axis of the structure lies on a non-Euclidean plane or is otherwise formed with a curvature.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Overlap: As used in this disclosure, an overlap refers to the placement of a second sheeting over a first sheeting such that the visibility of the first structure is at least partially obscured by the second structure.

Perimeter: As used in this disclosure, a perimeter is one or more curved or straight lines that bounds an enclosed area on a plane or surface. The perimeter of a circle is commonly referred to as a circumference.

Posterior: As used in this disclosure, posterior is a term that is used to refer to the side of an object that is distal or in the opposite direction of the anterior side. When comparing two items, the posterior item is the item that is distal from the anterior of the object.

Primary Shape: As used in this disclosure, the primary shape refers to a description of the overall geometric shape of an object that is assembled from multiple components.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Protected Space: As used in this disclosure, a protected space is a space formed by a boundary structure. The boundary structure forms a barrier that protects objects within the protected space from potential dangers from the other side of the boundary.

Relaxed Shape: As used in this disclosure, a structure is considered to be in its relaxed state when no shear, strain, or torsional forces are being applied to the structure.

Rigid Structure: As used in this disclosure, a rigid structure is a solid structure formed from an inelastic material that resists changes in shape. A rigid structure will permanently deform as it fails under a force.

Semi-Rigid Structure: As used in this disclosure, a semi-rigid structure is a solid structure that is stiff but not wholly inflexible and that will deform under force before breaking. A semi-rigid structure may or may not behave with an elastic nature in that a semi-rigid structure need not return to its relaxed shape.

Semitransparent: As used in this disclosure, semitransparent refers to an object that is partially transparent.

Sheeting: As used in this disclosure, a sheeting is a material, such as a paper, textile, a plastic, or a metal foil, in the form of a thin flexible layer or layers.

Sinister: As used in this disclosure, sinister is a directional reference that refers to the left side of the body or the left side of an object from the perspective of a viewer who is facing the posterior side of the object.

Superior: As used in this disclosure, the term superior refers to a directional reference that is parallel to and in the opposite direction of the force of gravity.

Textile: As used in this disclosure, a textile is a material that is woven, knitted, braided or felted. Synonyms in common usage for this definition include fabric and cloth.

Transparent: As used in this disclosure, transparent refers to a material that allows light to pass through the material without significant scattering such that an object can be clearly seen through the material.

Weather: As used in this disclosure, the term weather refers to a collection of measurable parameters of the atmosphere including, but not limited to, temperature, humidity, precipitation, air movement caused by wind and energy and illumination from the sun. A structure that isolates an individual or object from the more uncomfortable or destructive aspects of the weather is said to provide protection against the weather. The term elements is often used to refer to weather.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A face mask comprising a suspension band, a plurality of facepieces, a plurality of face guards, a plurality of guard mounts, and a protective structure;

wherein the plurality of facepieces is adapted to secure the suspension band to the head of the client;

wherein the plurality of guard mounts attach the plurality of face guards to the plurality of facepieces;

wherein the protective structure mounts on the plurality of face guards;

wherein the face mask is a garment;

wherein the face mask is adapted to be worn on the head of the client;

wherein the face mask is adapted to form a protected space around the face of the client;

wherein the suspension band is adapted to suspend the face mask from the head of the client;

wherein the protective structure is adapted to form the protected space that encloses the face of the client;

wherein the suspension band is a non-Euclidean disk structure;

wherein the non-Euclidean disk structure of the suspension band comprises a concave and a convex surface;

wherein the suspension band is a semi-rigid structure with an elastic nature;

wherein the suspension band is adapted to be worn over the superior surface of the head of the client;

wherein the suspension band is adapted to fit on the head of the client such that the plurality of facepieces are adapted to fit against the face of the client;

wherein the suspension band further attaches to a superior medial band and a lateral band;

wherein the superior medial band is a semi-rigid structure with an elastic nature;

wherein the superior medial band is worn over the superior surface of the head of the client;

wherein the superior medial band is perpendicular to the superior band;

wherein the lateral band is a semi-rigid structure with an elastic nature;

wherein the lateral band is adapted to be worn over the back of the head of the client;

wherein the lateral band is perpendicular to the superior medial band;

wherein each of the plurality of facepieces attaches to the convex surface of the suspension band;

wherein each of the plurality of facepieces are equidistant from the center of the suspension band;

wherein the position of each of the plurality of facepieces is such that each facepiece selected from the plurality of facepieces is adapted to fit directly against a face of the client.

2. The face mask according to claim 1 wherein each of the plurality of face guards is a non-Euclidean prism structure;

wherein each of the plurality of face guards is adapted to form a curved structure that encloses the face of the client;

wherein the plurality of guard mounts attach the plurality of face guards to the plurality of facepieces;

wherein the plurality of face guards attach to the protective structure; and wherein the plurality of face guards are adapted to hold the protective structure away from the face of the client.

3. The face mask according to claim 2 wherein each guard mount selected from the plurality of guard mounts attaches to a facepiece selected from the plurality of facepieces;

wherein the plurality of guard mounts comprise a collection of individual guard mounts.

4. The face mask according to claim 3 wherein the protective structure is a sheeting-based structure that is adapted to form the protected space that encloses the face of the client;

wherein the protected space formed by the protective structure is adapted to protect the face of the client from the weather;

wherein the protective structure comprises a rectangular mesh textile and a rectilinear mesh textile;

wherein the rectangular mesh textile is a textile-based sheeting;

wherein the rectangular mesh textile is formed as mesh structure;

wherein the rectangular mesh textile is adapted to form the physical protected space that protects the face of the client from the weather;

wherein the rectilinear mesh textile is a textile-based sheeting;

wherein the rectilinear mesh textile is formed as a mesh structure;

wherein the rectilinear mesh textile is adapted to form the physical protected space that protects the face of the client from the weather;

wherein the rectangular mesh textile and the rectilinear mesh textile attach to the plurality of face guards such that the rectangular mesh textile and the rectilinear mesh textile overlay each other.

5. The face mask according to claim 4 wherein the suspension band further comprises a sinister end and a dexter end;

wherein the sinister end is the point on the lateral face of the non-Euclidean disk structure that: a) is distal from the center point of the suspension band; b) is distal from the dexter end; and, c) is adapted to be proximal to the client;

wherein the dexter end is the point on the lateral face of the non-Euclidean disk structure that: a) is distal from the center point of the suspension band; b) is distal from the sinister end; and, c) is adapted to be proximal to the client.

6. The face mask according to claim 5 wherein the plurality of facepieces comprise a collection of individual facepieces;

wherein each individual facepiece is a rigid structure;

wherein each individual facepiece has the primary shape of a disk;

wherein each individual facepiece attaches at a position proximal to an end of the non-Euclidean disk structure of the suspension band;

wherein each individual facepiece attaches to the convex surface of the non-Euclidean disk structure of the suspension band;

wherein each individual facepiece is adapted to fit against a face of the client;

wherein each individual facepiece attaches an individual guard mount selected from the plurality of guard mounts to the suspension band;

wherein each individual facepiece comprises an individual facepiece plate and an individual facepiece cavity;

wherein the individual guard mount selected to attach to the individual facepiece attaches to the face of the disk structure of the individual facepiece plate that is adapted to be distal from the client;

wherein the individual facepiece plate is a rigid structure;

wherein the individual facepiece plate has the primary shape of a disk;

wherein the individual facepiece plate has a plate structure;

wherein the individual facepiece plate is sized such that the individual facepiece plate is adapted to extend beyond the non-Euclidean disk structure of the suspension band to a position against a face of the client;

wherein the individual facepiece cavity is a negative space formed in the congruent end of the individual facepiece plate that is adapted to be proximal to the head of the client;

wherein the negative space that forms the individual facepiece cavity is a prism-shaped structure.

7. The face mask according to claim 6 wherein plurality of face guards comprises a superior face guard and an inferior face guard;

wherein the superior face guard is a non-Euclidean prism structure;

wherein the superior face guard is a rigid structure;

wherein the superior face guard is positioned on the face mask such that the superior face guard is adapted to enclose the face of the client;

wherein the superior face guard is positioned on the face mask such that the protected space is adapted to be formed between the protective structure and the face of the client;

wherein the inferior face guard is a non-Euclidean prism structure;

wherein the inferior face guard is a rigid structure;

wherein the inferior face guard is positioned on the face mask such that the inferior face guard is adapted to enclose the face of the client;

wherein the inferior face guard is positioned on the face mask such that the protected space is adapted to be formed between the protective structure and the face of the client.

8. The face mask according to claim 7 wherein each individual guard mount comprises an individual piece mount plate, and an individual guard clamp plate;

wherein the individual guard clamp plate attaches to the individual piece mount plate.

9. The face mask according to claim 8 wherein the individual piece mount plate is a rigid structure;

wherein the individual piece mount plate is a disk-shaped plate;

wherein the individual piece mount plate is the component of the individual guard mount that directly attaches to the individual facepiece selected from the plurality of facepieces that is associated with the selected individual guard mount.

10. The face mask according to claim 9 wherein each individual piece mount plate comprises a first individual c-channel and a second individual c-channel;

wherein the first individual c-channel is a negative space formed in the congruent end of the individual piece mount plate that is adapted to be distal from the head of the client;

wherein the first individual c-channel is geometrically similar to the prism shape of a face guard selected from the plurality of face guards;

wherein the first individual c-channel is sized such that a face guard selected from the plurality of face guards fits within the first individual c-channel;

wherein the second individual c-channel is a negative space formed in the congruent end of the individual piece mount plate that is adapted to be distal from the head of the client;

wherein the second individual c-channel is geometrically similar to the prism shape of a face guard selected from the plurality of face guards;

wherein the second individual c-channel is sized such that a face guard selected from the plurality of face guards fits within the second individual c-channel.

11. The face mask according to claim 10 wherein the individual guard clamp plate is a rigid structure;

wherein the individual guard clamp plate is a disk-shaped plate;

wherein the individual guard clamp plate attaches to the individual piece mount plate;

wherein the individual guard clamp plate encloses each of the plurality of face guards between the individual guard clamp plate and the individual piece mount plate such that each of the plurality of face guards are secured to the face mask;

wherein the individual guard clamp plate comprises a third individual c-channel, and a fourth individual c-channel;

wherein the third individual c-channel is a negative space formed in the congruent end of the individual guard clamp plate that is proximal to the individual piece mount plate;

wherein the third individual c-channel is geometrically similar to the prism shape of a face guard selected from the plurality of face guards;

wherein the third individual c-channel is sized such that a face guard selected from the plurality of face guards fits within the third individual c-channel;

wherein the fourth individual c-channel is a negative space formed in the congruent end of the individual guard clamp plate that is proximal to the individual piece mount plate;

wherein the fourth individual c-channel is geometrically similar to the prism shape of a face guard selected from the plurality of face guards;

wherein the fourth individual c-channel is sized such that a face guard selected from the plurality of face guards fits within the fourth individual c-channel.

12. The face mask according to claim 11 wherein the plurality of facepieces further comprises a sinister facepiece and a dexter facepiece;

wherein the sinister facepiece is the individual facepiece that is adapted to be positioned on the sinister side of the head of the client;

wherein the dexter facepiece is the individual facepiece that is adapted to be positioned on the dexter side of the head of the client.

13. The face mask according to claim 12 wherein the plurality of guard mounts further comprises a sinister guard mount and a dexter guard mount;

wherein the sinister guard mount is the individual guard mount that is adapted to be positioned on the sinister side of the head of the client;

wherein the dexter guard mount is the individual guard mount that is adapted to be positioned on the dexter side of the head of the client.

14. The face mask according to claim 13 wherein each sinister facepiece comprises a sinister facepiece plate and a sinister facepiece cavity;

wherein each dexter facepiece comprises a dexter facepiece plate and a dexter facepiece cavity;

wherein the sinister facepiece plate is the individual facepiece plate that is adapted to be positioned on the sinister side of the head of the client;

wherein the sinister facepiece cavity is the individual facepiece cavity that is adapted to be positioned on the sinister side of the head of the client;

wherein the dexter facepiece plate is the individual facepiece plate that is adapted to be positioned on the dexter side of the head of the client;

wherein the dexter facepiece cavity is the individual facepiece cavity that is adapted to be positioned on the dexter side of the head of the client.

15. The face mask according to claim 14 wherein the sinister guard mount further comprises a sinister piece mount plate and a sinister guard clamp plate;

wherein the sinister piece mount plate further comprises a first sinister c-channel, and a second sinister c-channel;

wherein the sinister guard clamp plate further comprises a third sinister c-channel, and a fourth sinister c-channel;

wherein the sinister piece mount plate is the individual piece mount plate that is adapted to be positioned on the sinister side of the head of the client;

wherein the sinister guard clamp plate is the individual guard clamp plate that is adapted to be positioned on the sinister side of the head of the client;

wherein the first sinister c-channel is the first individual c-channel that is adapted to be positioned on the sinister side of the head of the client;

wherein the second sinister c-channel is the second individual c-channel that is adapted to be positioned on the sinister side of the head of the client;

wherein the third sinister c-channel is the third individual c-channel that is adapted to be positioned on the sinister side of the head of the client;

wherein the fourth sinister c-channel is the fourth individual c-channel that is adapted to be positioned on the sinister side of the head of the client.

16. The face mask according to claim 15 wherein the dexter guard mount comprises a dexter piece mount plate, and a dexter guard clamp plate;

wherein the dexter piece mount plate further comprises a first dexter c-channel and a second dexter c-channel;

wherein the dexter guard clamp plate further comprises a third dexter c-channel, and a fourth dexter c-channel;

wherein the dexter piece mount plate is the individual piece mount plate that is adapted to be positioned on the dexter side of the head of the client;

wherein the dexter guard clamp plate is the individual guard clamp plate that is adapted to be positioned on the dexter side of the head of the client;

wherein the first dexter c-channel is the first individual c-channel that is adapted to be positioned on the dexter side of the head of the client;

wherein the second dexter c-channel is the second individual c-channel that is adapted to be positioned on the dexter side of the head of the client;

wherein the third dexter c-channel is the third individual c-channel that is adapted to be positioned on the dexter side of the head of the client;

wherein the fourth dexter c-channel is the fourth individual c-channel that is adapted to be positioned on the dexter side of the head of the client.

* * * * *